US010068510B2

(12) United States Patent
Lee

(10) Patent No.: US 10,068,510 B2
(45) Date of Patent: Sep. 4, 2018

(54) DISPLAY PANEL AND INSPECTION METHOD THEREOF

(71) Applicant: LG DISPLAY CO., LTD., Seoul (KR)

(72) Inventor: JunYeob Lee, Gyeongsan-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 15/373,542

(22) Filed: Dec. 9, 2016

(65) Prior Publication Data

US 2017/0193872 A1 Jul. 6, 2017

(30) Foreign Application Priority Data

Dec. 31, 2015 (KR) ..... 10-2015-0191865

(51) Int. Cl.

*G09G 5/00* (2006.01)
*G09G 3/00* (2006.01)
*G09G 3/20* (2006.01)

(52) U.S. Cl.

CPC ..... *G09G 3/006* (2013.01); *G09G 3/2003* (2013.01); *G09G 2300/0426* (2013.01); *G09G 2300/0452* (2013.01); *G09G 2310/0297* (2013.01); *G09G 2320/0223* (2013.01); *G09G 2320/0233* (2013.01); *G09G 2330/12* (2013.01)

(58) Field of Classification Search

CPC ..... G09G 3/006; G09G 3/2003; G09G 2320/0233; G09G 2300/0452; G09G 2320/0223; G09G 2310/0297; G09G 2300/0426; G09G 2330/12

See application file for complete search history.

(56) References Cited

U.S. PATENT DOCUMENTS

2014/0354285 A1 12/2014 Kim et al.
2014/0354286 A1* 12/2014 Kim ..... G09G 3/006 324/414
2015/0241501 A1 8/2015 Jang et al.

FOREIGN PATENT DOCUMENTS

EP 2600627 A2 6/2013

* cited by examiner

*Primary Examiner* — Jonathan Boyd
(74) *Attorney, Agent, or Firm* — Birch, Stewart, Kolasch & Birch, LLP

(57) ABSTRACT

A display panel is discussed. The display panel according to an embodiment includes driver integrated circuits (ICs); data lines disposed in an active region; input pads disposed in a pad region; output pads disposed in a first inspection circuit included in the pad region, the output pads receiving first signals from the input pads; and a first switching circuit disposed in the first inspection circuit and connected to the output pads. The first switching circuit is configured to supply the first signals to the data lines. The display panel further includes first signal lines configured to supply the first signals to the output pads; a second switching circuit disposed in a second inspection circuit and connected to the data lines in the active region; and a second signal line configured to supply second signals to the second switching circuit.

20 Claims, 11 Drawing Sheets

<AP DEFECT INSPECTION>

<1st AP DEFECT INSPECTION>

<1st AP DEFECT INSPECTION>

<2nd AP DEFECT INSPECTION>

<2nd AP DEFECT INSPECTION>

DISPLAY PANEL AND INSPECTION METHOD THEREOF

CROSS-REFERENCE TO RELATED APPLICATION

This application claims priority from Korean Patent Application Number 10-2015-0191865 filed on Dec. 31, 2015, which is hereby incorporated by reference for all purposes as if fully set forth herein.

BACKGROUND OF THE INVENTION

Field of the Invention

The present invention relates to a display panel and an inspection method thereof.

Discussion of the Related Art

Recently, display devices, such as liquid crystal displays (LCDs), organic light-emitting diode (OLED) display devices, plasma display panels (PDPs), and electrophoretic displays (EPDs), have been fabricated using several types of fabrication processes. After a display panel is completed using such a fabrication process, an auto-probe inspection process of determining whether or not a defect is present in signal lines (e.g., data lines) and subpixels SPs formed on the display panel is performed.

In display devices, display panels have the function of displaying images. The auto-probe inspection process, which is also referred to as a lighting test, is a process of inputting an inspection signal to a display panel to determine whether or not the display panel operates ordinarily in response to the inspection signal. In order to perform such an auto-probe inspection process, an inspection section for supplying inspection signals and an input pad section for receiving signals from an external system are formed in a pad area of the display panel. A plurality of output pads is arranged on an output pad section of the inspection section, and is connected to data lines in an active area. The auto-probe inspection process determines, for example, whether a defect is present in data lines disposed in the active area, whether a defect is present in subpixels, or whether there is a defect in luminance, by supplying an inspection signal to the data lines from the output pad section.

However, a drive integrated circuit (IC) mounted on the pad area depending on the model or resolution of the display device does not use all of the output pads disposed on the output pad section. The non-used output pads are dummy pads present between active output pads that are used. When all of the output pads of the output pad section are not used, the data lines disposed in the active area are disconnected from the non-used output pads, such that resistance differences $\Delta R$ are formed by the non-used output pads during the auto-probe inspection process.

Therefore, when a specific gray-scale pattern or a white pattern is displayed on the display panel to determine whether or not a defect is present in the active area using the auto-probe inspection process, a defect in luminance (e.g., a dimmed area) is formed in an area of the non-used pads due to a resistance difference formed by the non-used pads. In other words, although the display panel is fully operational, a defect in luminance in the display panel according to the related art may occur during the auto-probe inspection process, thereby lowering the precision of the inspection process.

SUMMARY OF THE INVENTION

Various aspects of the present invention provide a display panel and an inspection method thereof, in which a first inspection circuit and a second inspection circuit able to perform an auto-probe inspection process on the display panel are provided. A more precise defect inspection can thereby be performed by comparing patterns displayed on the display panel by the first inspection circuit with patterns displayed on the display panel by the second inspection circuit.

According to an aspect of the present invention, a display panel may include an active area (e.g., active region) including a plurality of subpixels; a pad area having a first inspection circuit disposed therein to supply first inspection signals to the active area in order to determine whether or not a defect is present in the active area; and a second inspection circuit facing the first inspection circuit, with the active area being situated between the first and second inspection circuits. The first inspection circuit includes a plurality of output pads connected to data lines disposed in the active area, a first switching circuit supplying the first inspection signals to the plurality of output pads, and first signal lines through which the first inspection signals are supplied to the first switching circuit. The second inspection circuit includes a second switching circuit connected to the data lines in the active area and a second signal line through which second inspection signals are supplied to the second switching circuit.

According to another aspect of the present invention, a display panel includes an active area including a plurality of subpixels, a pad area having a first inspection circuit disposed therein to supply first inspection signals to the active area, and a second inspection circuit facing the first inspection circuit, with the active area being situated between the first and second inspection circuits. An inspection method of a display panel includes displaying a first gray-scale pattern by supplying the first inspection signals to data lines in the active area using the first inspection circuit; displaying a second gray-scale pattern by supplying second inspection signals to the data lines in the active area of the display panel using the second inspection circuit; and determining whether or not there is a defect by comparing the first gray-scale pattern and the second gray-scale pattern displayed on the display panel.

In the display panel and the inspection method thereof according to the present invention, the first inspection circuit and the second inspection circuit are able to perform an auto-probe inspection process on the display panel. A more precise defect inspection process of the display panel can thereby be performed by comparing patterns displayed on the display panel by the first inspection circuit with patterns displayed on the display panel by the second inspection circuit.

DETAILED DESCRIPTION OF THE EMBODIMENTS

Figure 1:
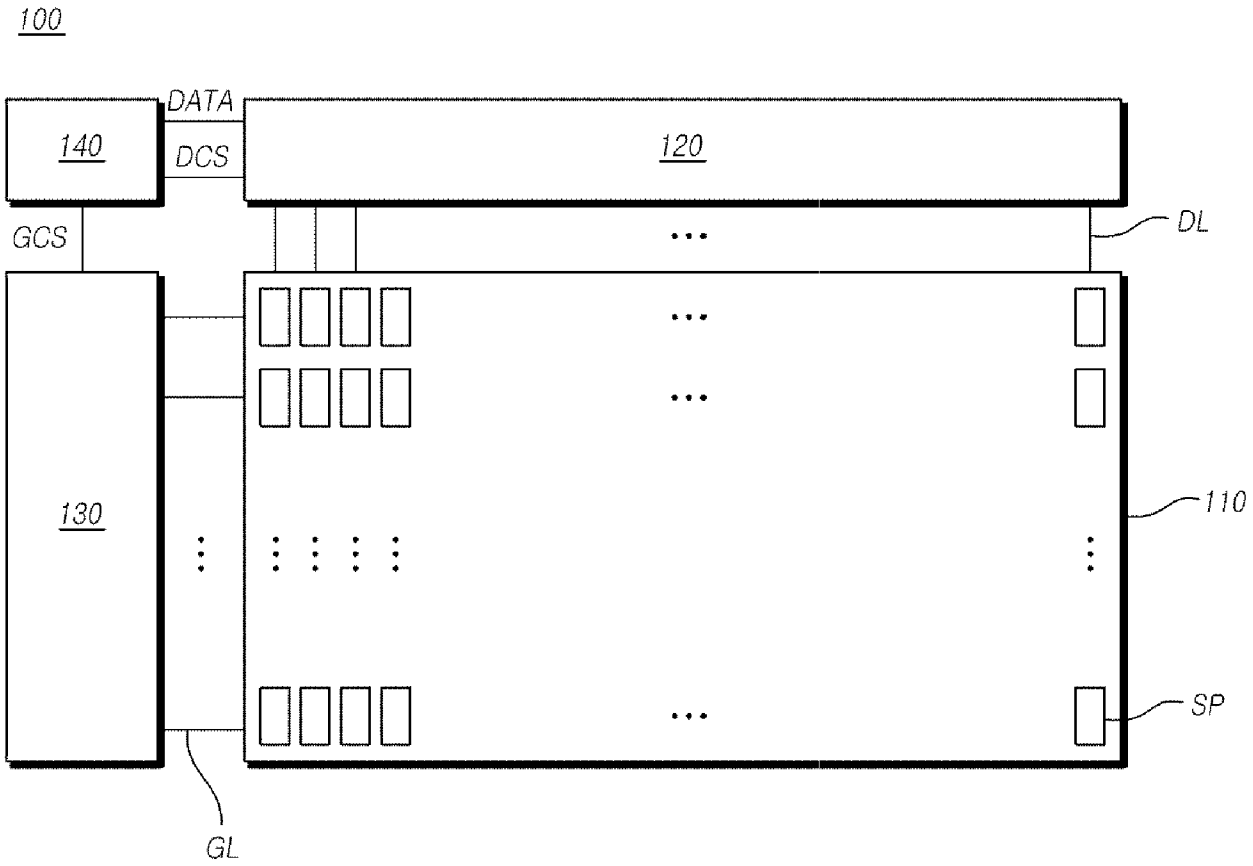
FIG. 1 is a configuration view schematically illustrating a display device according to an exemplary embodiment.

The above and other objects, features and advantages of the present invention and methods of obtaining the same will be more clearly understood from the following detailed description of the embodiments when taken in conjunction with the accompanying drawings. The present invention may, however, be embodied in many different forms and should not be construed to be limited to the embodiments set forth herein. Rather, these embodiments are provided so that this invention will be thorough and complete, and will fully convey the scope of the invention to a person skilled in the art. It should be understood that the scope of the present invention is defined only by the appended claims.

Shapes, sizes, ratios, angles, numbers, and so on illustrated on the drawings to described embodiments are illustrative only, and the present invention is by no means limited thereto. Throughout this document, the same reference numerals and signs designate the same or like components. In the following description of the present invention, detailed descriptions of known functions and components incorporated herein will be omitted in the case that the subject matter of the present invention may be rendered unclear thereby.

It will be understood that the terms "comprise," "include," "have," and any variations thereof used herein are intended to cover a non-exclusive inclusion unless an exclusive term, such as "only" or "exclusively," is used. As is used herein, the singular forms are intended to include the plural forms as well, unless explicitly described to the contrary.

The components will be construed as including tolerances, unless explicitly described to the contrary. In the description of positional relationships, for example, when the positional relationship between two parts is defined using the term, such as "on," "on top of," "under," or "on a side of", at least one intervening element may be positioned between the two parts unless a term, such as "directly" or "immediately," is used. In the description of time relationships, for example, when a time sequential relationship between two operations is described using the term, such as "after," "subsequent to," "then," or "before," the two operations may not be continuous unless a term, such as "directly" or "immediately," is used.

Although the terms, such as "first" and "second," may be used herein to describe a variety of components, these components are not limited by these terms. It should be understood, however, that these terms are only used to distinguish one component from another component. Therefore, a component mentioned as a first component hereinafter may be a second component within the principle of the present invention.

The features of various embodiments of the present invention, respectively, may be combined or mixed in part or entirely, and various technical interactions and operations may be possible. The embodiments, respectively, may be carried out in an independent or interactive manner to one another.

Hereinafter, reference will be made to embodiments of the present invention in detail in conjunction with the accompanying drawings. In the drawings, the size and thickness of elements may be exaggerated for the sake of clarity. Throughout this document, the same reference numerals and signs will be used to designate the same or like components.

FIG. 1 is a configuration view schematically illustrating a display device 100 according to an exemplary embodiment. The display device 100 according to the present embodiment includes a display panel 110, a source driver 120, a scanning driver 130, and a timing controller 140. The display panel 110 has a plurality of data lines DLs, a plurality of gate lines GLs, and a plurality of subpixels SPs disposed thereon. The source driver 120 drives the plurality of data lines DLs. The scanning driver 130 drives the plurality of gate lines GLs. The timing controller 140 controls the source driver 120 and the scanning driver 130.

The timing controller 140 controls the source driver 120 and the scanning driver 130 by supplying a variety of control signals thereto. The timing controller 140 starts scanning based on timing realized by each frame, converts image data input from an external source into a data signal format readable by the source driver 120, outputs the converted image data, and at a suitable point in time, regulates data processing in response to the scanning.

The source driver 120 drives the plurality of data lines DLs by supplying driving data voltages Vdata thereto. The source driver 120 is also referred to as a "data driver."

The scanning driver 130 sequentially drives the plurality of gate lines GLs by sequentially supplying scanning signals thereto. The scanning driver 130 is also referred to as a "gate driver." The scanning driver 130 sequentially supplies scanning signals respectively having an on or off voltage to the plurality of gate lines GLs under the control of the timing controller 140. When a specific gate line is opened by the scanning driver 130, the source driver 120 converts image data received from the timing controller 140 into analog data voltages and supplies the analog data voltages to the plurality of data lines DLs.

The source driver 120 can be positioned on one side (e.g., an upper side or a lower side) of the display panel 110, as illustrated in FIG. 1. Alternatively, the source driver 120 may be positioned on both sides (e.g., both the upper side and the lower side) of the display panel 110 depending on the driving system or the design of the panel.

The scanning driver 130 is positioned on one side (e.g., a left side or a right side) of the display panel 110, as illustrated in FIG. 1. Alternatively, the scanning driver 130 may be positioned on both sides (e.g., both the left side and the right side) of the display panel 110 depending on, for example, the driving system or the design of the panel.

The timing controller 140 receives a variety of timing signals including a vertical synchronization signal Vsync, a horizontal synchronization signal Hsync, an input data enable (DE) signal, and a clock signal, as well as input image data, from an external source (e.g., an external host system). The timing controller 140 not only converts image data input from an external source into a data signal format readable by the source driver 120 and outputs the converted image data, but also generates a variety of control signals by receiving a variety of received timing signals, including a vertical synchronization signal Vsync, a horizontal synchronization signal Hsync, an input DE signal, and a clock signal. The timing controller 140 outputs the variety of control signals to the source driver 120 and the scanning driver 130 in order to control the source driver 120 and the scanning driver 130. For example, the timing controller 140 outputs a variety of gate control signals (GCSs) including a gate start pulse (GSP), a gate shift clock (GSC) signal, and a gate output enable (GOE) signal in order to control the scanning driver 130.

Here, the GSP is used to control the operation start timing of one or more gate driver integrated circuits (GDICs) of the scanning driver 130. The GSC signal is a clock signal commonly input to the GDICs to control the shift timing of scanning signals (e.g., gate pulses). The GOE signal designates the timing information of one or more GDICs.

In addition, the timing controller 140 outputs a variety of data control signals (DCSs) including a source start pulse (SSP), a source sampling clock (SSC) signal, and a source output enable (SOE) signal in order to control the source driver 120. Here, the SSP is used to control the data sampling start timing of one or more SDICs of the source driver 120. The SSC signal is a clock signal controlling the data sampling timing of each of the SDICs. The SOE signal is used to control the output timing of the source driver 120.

The source driver 120 may include one or more source driver integrated circuits (SDICs) to drive the plurality of data lines. Each of the SDICs may include a shift register, a latch circuit, a digital-to-analog converter (DAC), an output buffer, and a gamma voltage generator. In some cases, each of the SDICs may further include an analog-to-digital converter (ADC).

The scanning driver 130 may include one or more gate driver integrated circuits (GDICs). Each of the GDICs may include a shift register and a level shifter.

Each of the subpixels SPs disposed on the display panel 110 may include circuit elements, such as a transistor. For example, in the display panel 110, each of the subpixels SPs includes circuit elements, such as an organic light-emitting diode (OLED) and a driving transistor DRT for driving the OLED.

The types and number of the circuit elements of each of the subpixels SPs may be determined variously depending on functions provided thereby and the design thereof. In addition, the subpixels SPs may be subpixels of a flat panel display device, such as a liquid crystal display (LCD) or a plasma display device, respectively having a switching transistor, a pixel electrode, and a common electrode.

Figure 2:
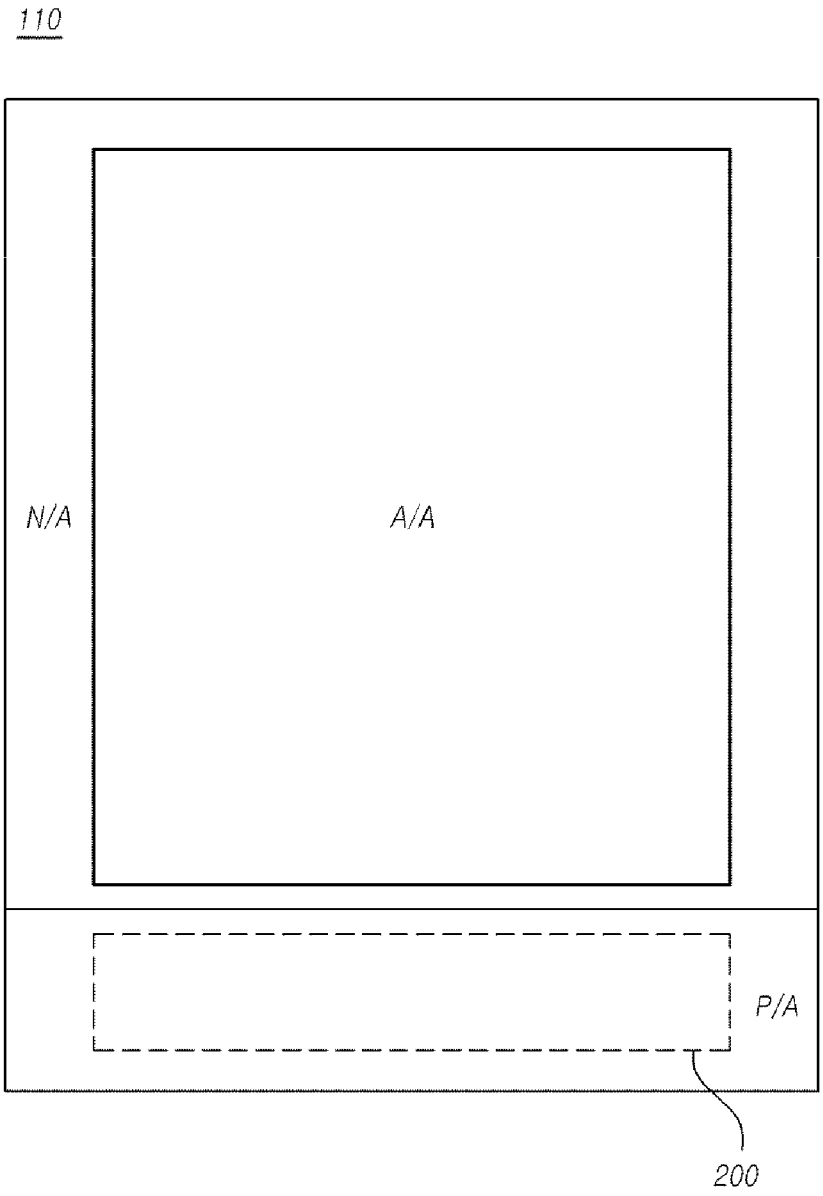
FIG. 2 is a top view illustrating the display panel of the display device according to an exemplary embodiment.
Figure 3:
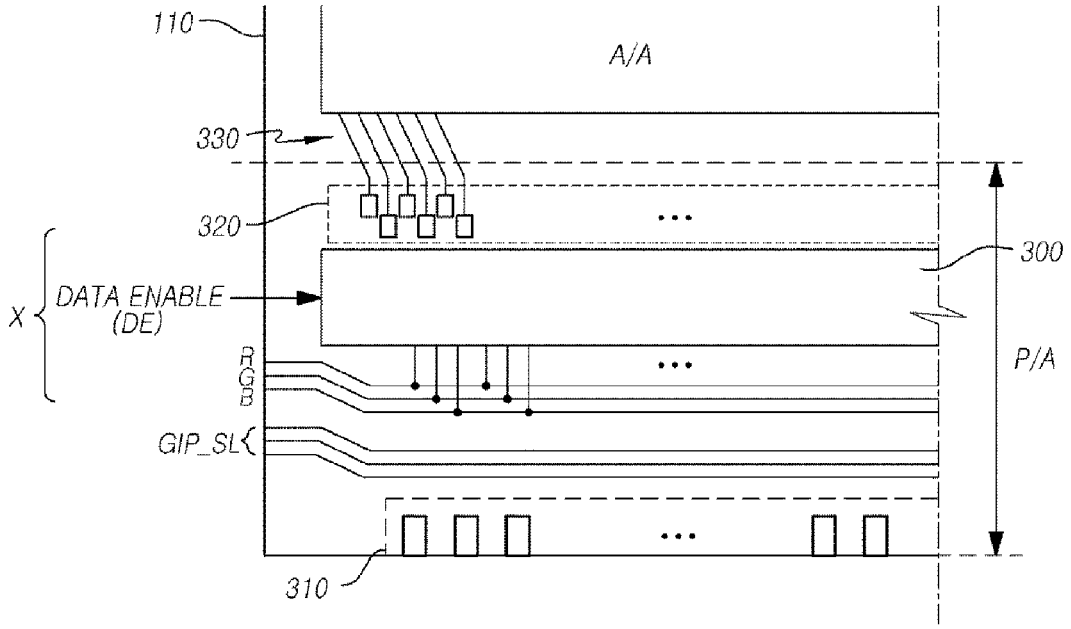
FIG. 3 is an enlarged view of the pad area P/A in FIG. 2.

Next, FIG. 2 is a top view illustrating the display panel 110 of the display device according to the exemplary embodiment, and FIG. 3 is an enlarged view of a pad area P/A in FIG. 2. The display panel 110 of the display device according to the exemplary embodiment includes an active area A/A (e.g., active region) for displaying images, a non-active area N/A (e.g., non-active region) surrounding the active area A/A, and a pad area P/A having a driver integrated circuit (IC) mounting area 200 on which driver integrated circuits (ICs), for example, are disposed.

The driver ICs may be implemented as ICs devised to output data voltages to the data lines disposed on the display panel 110 and output scanning pulses to the gate lines GLs disposed on the display panel 110. The driver ICs may include one or more ICs from among driver ICs used in the source driver, the scanning driver, and the timing controller.

In the IC mounting area 200 of the pad area P/A, an input pad section 310, an output pad section 30, first signal lines R, G, and B through which signals are supplied to red, green, and blue (RGB) subpixels, and a switching circuit connected to the first signal lines are disposed. A portion designated by a gate in panel signal line (GIP_SL) in the drawing indicates GIP signal lines through which clock signals are supplied to the scanning driver (e.g., gate driver) disposed on the display panel 110.

In addition, the output pad section 320, the first signal lines through which signals are supplied to the RGB subpixels, and a switching circuit 300 can function as a first inspection circuit X to perform an auto-probe inspection process. The input pad section 310 includes a plurality of input pads disposed thereon, through which signals received from an external source are supplied to the driver ICs. The output pad section 320 includes a plurality of output pads through which a plurality of signals supplied from the driver ICs are output to the active area A/A or inspection signals supplied through the first signal lines R, G, and B are output to the active area A/A during the auto-probe inspection process. The output pads are connected to the link lines 330 connected to the signal lines (e.g., data lines) of the active area A/A.

When forming of the display panel 110 is completed, before the driver ICs are disposed on the driver IC mounting area 200, the auto-probe inspection process is performed. The auto-probe inspection process is performed to determine whether an open defect or a short defect is present in the data lines DLs disposed in the active area A/A, whether there is a defect in the subpixels SPs, whether there is a defect in luminance (e.g., gray-scale), and whether there is a defect in color mixing.

Figure 4A:
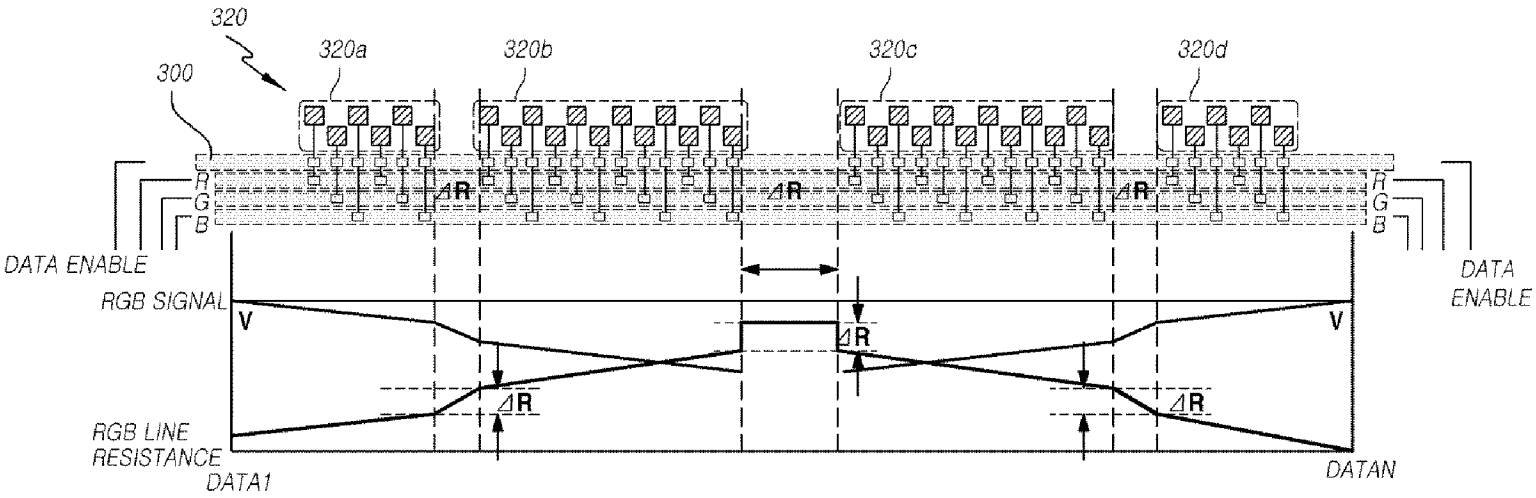
FIG. 4A illustrates resistance characteristics of the pad structure and a matching area of the display panel.
Figure 4B:
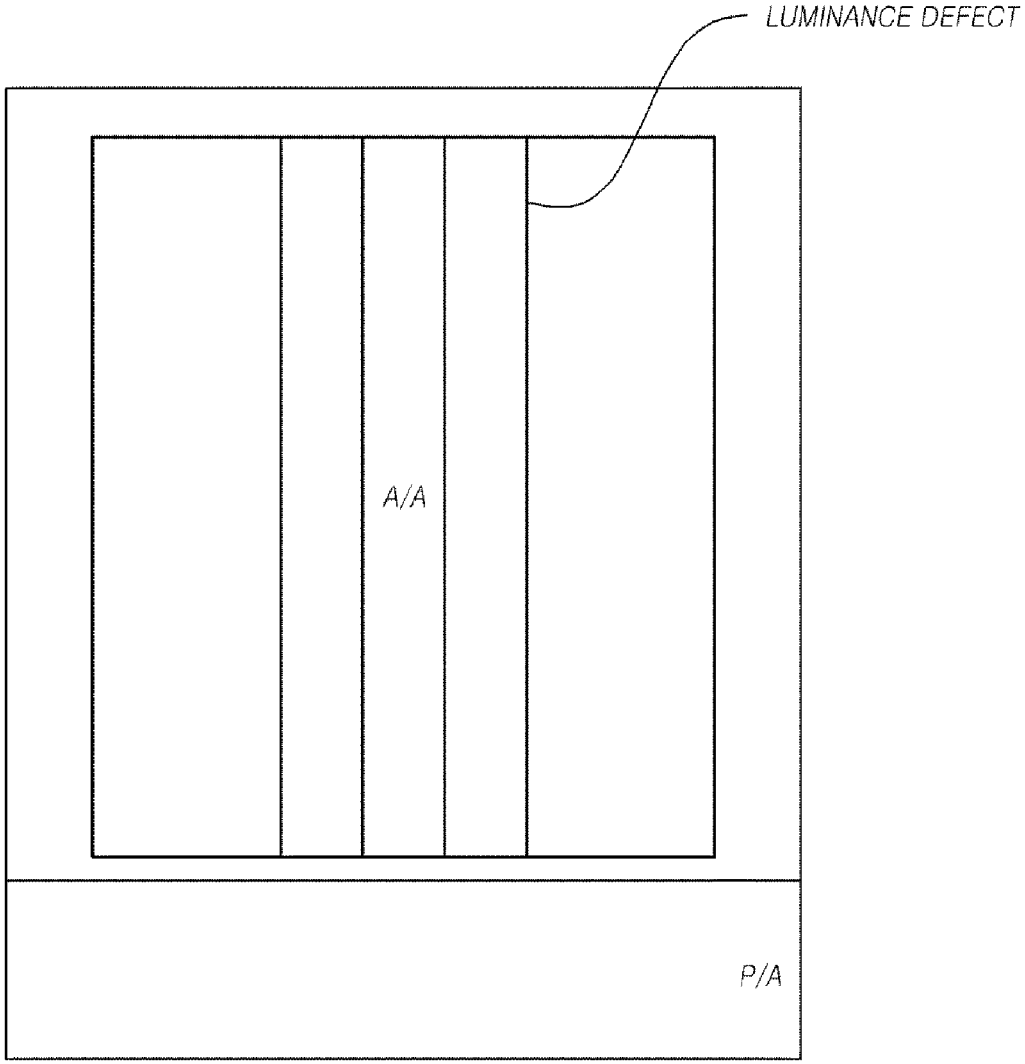
FIG. 4B illustrates a defect in luminance occurring when an auto-probe inspection process is performed on a display panel.

Next, FIG. 4A illustrates resistance characteristics of the pad structure and a matching area of the display panel, and FIG. 4B illustrates a defect in luminance occurring when an auto-probe inspection process is performed on a display panel. The first inspection circuit X is disposed in the pad area P/A of the display panel to perform the auto-probe inspection process (refer to FIG. 4A and FIG. 4B together with FIG. 3).

In the auto-probe inspection process, inspection signals are supplied to the active area A/A through the first signal lines R, G, and B through which signals are supplied to the RGB subpixels in the first inspection circuit X. The inspection signals may be RGB inspection signals or may be inspection signals for displaying a specific gray-scale pattern or a white pattern.

Inspection signals supplied to the first inspection circuit X are supplied to the data lines DLs disposed in the active area A/A through the output pad section 320 and the link lines 330, in response to the operation of the first switching circuit 300 (refer to FIG. 4A). The first switching circuit 300 may include a plurality of transistors. Data enable (DE) signals are supplied to enable the switching operation of the transistors.

Thus, the auto-probe inspection process sequentially supplies the RGB inspection signals through the data lines DLs to determine whether an open defect is present in the data lines DLs, whether there is a short defect in the data lines DLs, and whether there is a defect in the color mixing among the subpixels. In addition, inspection signals able to display a specific gray-scale pattern or a white pattern are supplied through the data lines to determine whether there is a defect in luminance. Although all of the output pads disposed on the first inspection circuit X of the display panel 110 may be connected to the data lines as required, predetermined output pads from among the output pads are formed as dummy pads, i.e., non-used pads.

Specifically, the output pads disposed on the output pad section 320 of the first inspection circuit X include dummy pad regions disposed at predetermined distances, such that the non-used output pads are alternately positioned with respect to the first to fourth output pad groups 320*a*, 320*b*, 320*c*, and 320*d*. Thus, when inspection signals are supplied from the first inspection circuit X, the inspection signals are supplied to the data lines only through the first to fourth output pad groups 320*a*, 320*b*, 320*c*, and 320*d*, such that significantly-larger resistance differences ΔR are present among the first to fourth output pad groups 320*a*, 320*b*, 320*c*, and 320*d* than among the output pads.

In addition, RGB inspection signals are supplied through one peripheral area of the first signal lines R, G, and B in the auto-probe inspection process (refer to FIG. 4A). Resistance differences in the signal lines at the peripheral area of the first signal lines R, G, and B are smaller than resistance differences at the center of the of first signal lines R, G, and B (e.g., resistance differences in the signal lines increase in the direction from the periphery to the center of the first signal lines R, G, and B). In addition, voltages of the RGB inspection signals at the peripheral area of the first signal lines R, G, and B are larger than voltages of the RGB inspection signals at the center of the first signal lines R, G, and B (refer to FIG. 4A; e.g., in regard to the resistance characteristics of the first signal lines R, G, and B and the voltage characteristics of the RGB inspection signals, line resistances increase but the voltages of the RGB inspection signals become lower in the direction from the periphery to the center of the first signal lines R, G, and B).

The large resistance differences AR cause significant changes in the resistances and the voltages of the inspection signals among the first to fourth output pad groups 320*a*, 320*b*, 320*c*, and 320*d*. As described above, according to the requirements of the display device, predetermined output pads from among the output pads disposed in the pad area P/A are formed as dummy pads, or non-used pads. In other words, regions having larger resistance differences ΔR are formed to include the predetermined output pads being formed as dummy pads, or non-used pads. The output pads disposed on the output pad section 320 are not matched with the data lines disposed in the active area A/A in a one-to-one correspondence.

Thus, in the display device according to related art, a defect in luminance (e.g., dimming) is formed in the auto-probe inspection process. That is, the defect in luminance in the display device according to related art may occur, even in the case in which the display panel 110 has no defective subpixels, due to the structural resistance differences when a specific gray-scale pattern or a white pattern is displayed on the display panel.

In the display panel and the inspection method thereof according to the present invention, a first inspection circuit and a second inspection circuit are disposed on both sides of the active area to perform a defect inspection process on the display panel. The first inspection circuit serves to determine an open defect in the data lines DLs, a short defect, a defect in luminance, or a defect in color mixing. A more precise defect inspection process can be performed by allowing the first and second inspection circuits of the display panel to display a specific gray-scale pattern or a white pattern for the defect inspection for comparing the gray-scale pattern formed by the first inspection circuit with the gray-scale pattern formed by the second inspection circuit.

Figure 5A:
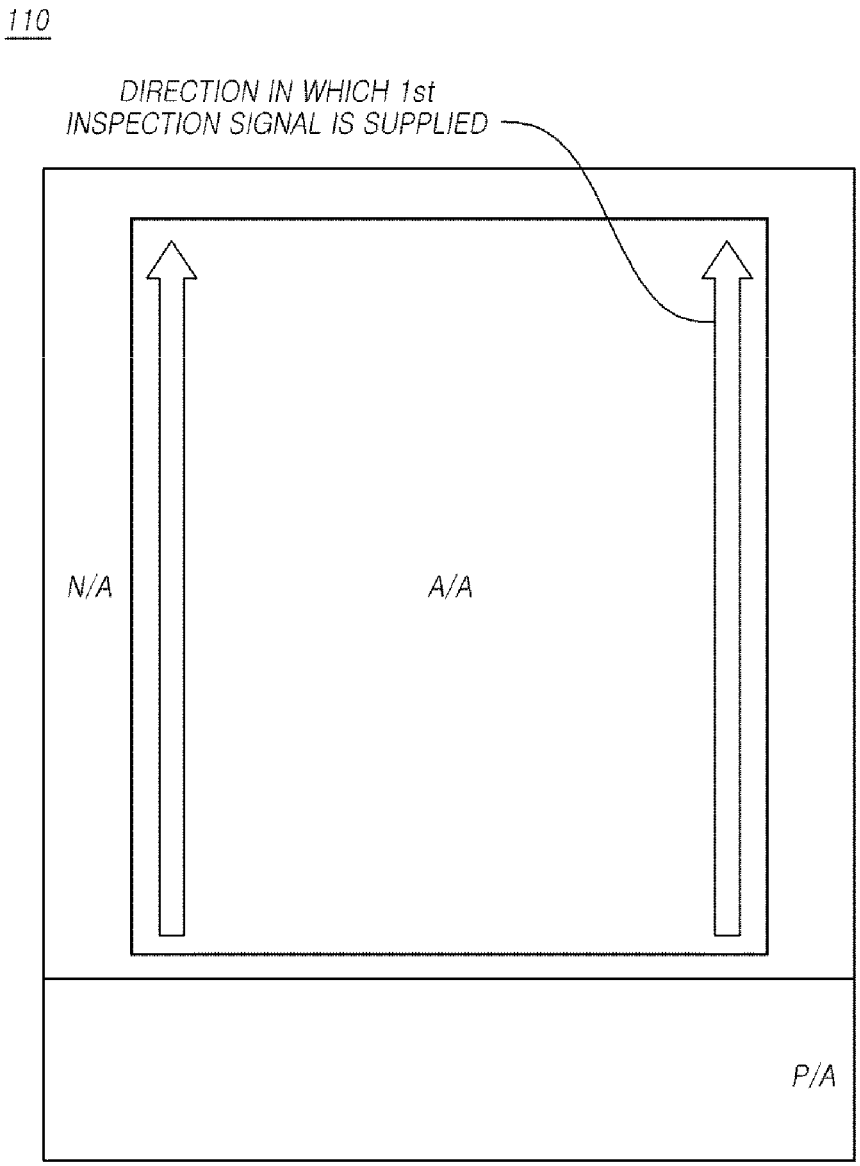
FIG. 5A and FIG. 5B illustrate a first auto-probe inspection process performed on the display panel of the display device according to an exemplary embodiment.
Figure 5B:
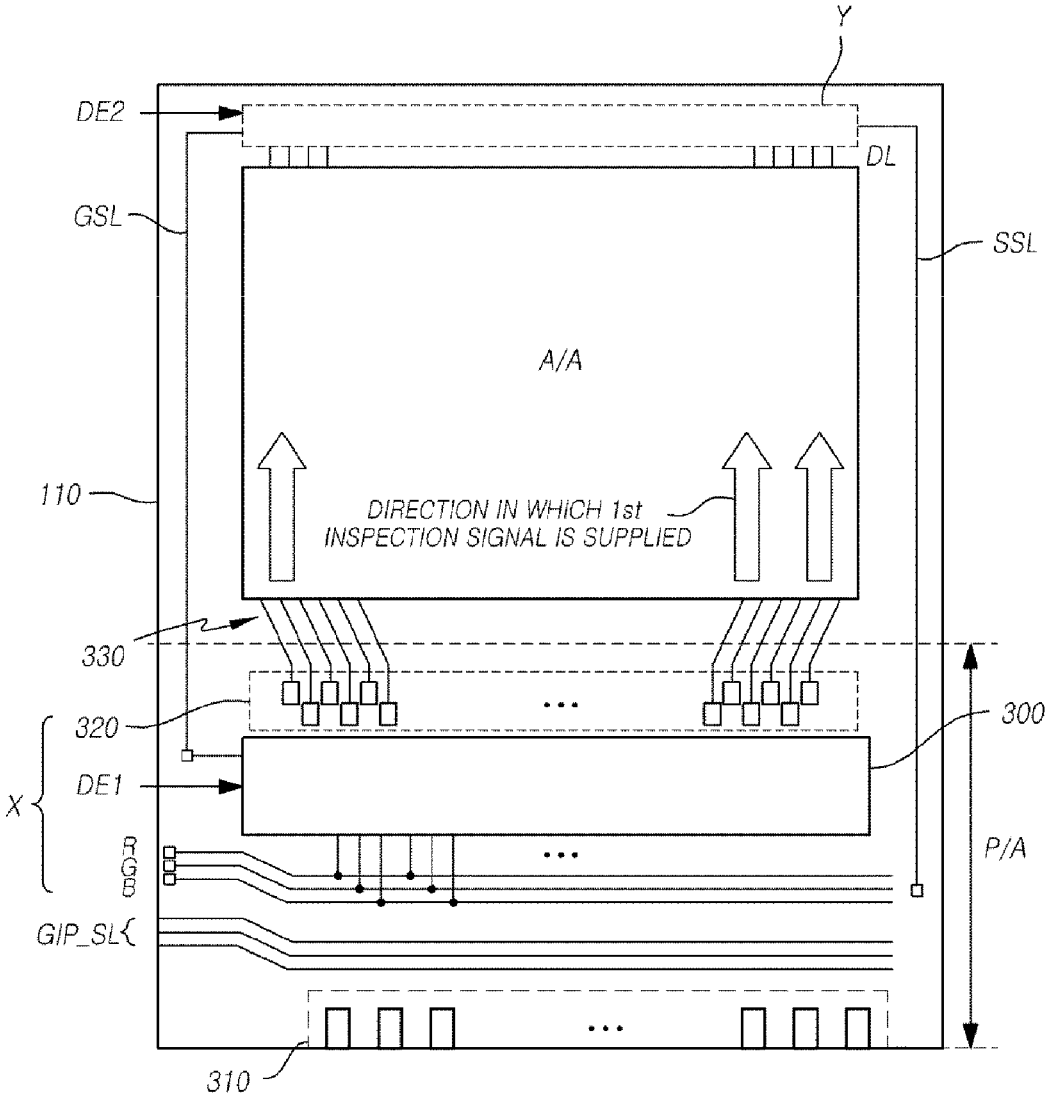
Figure 6A:
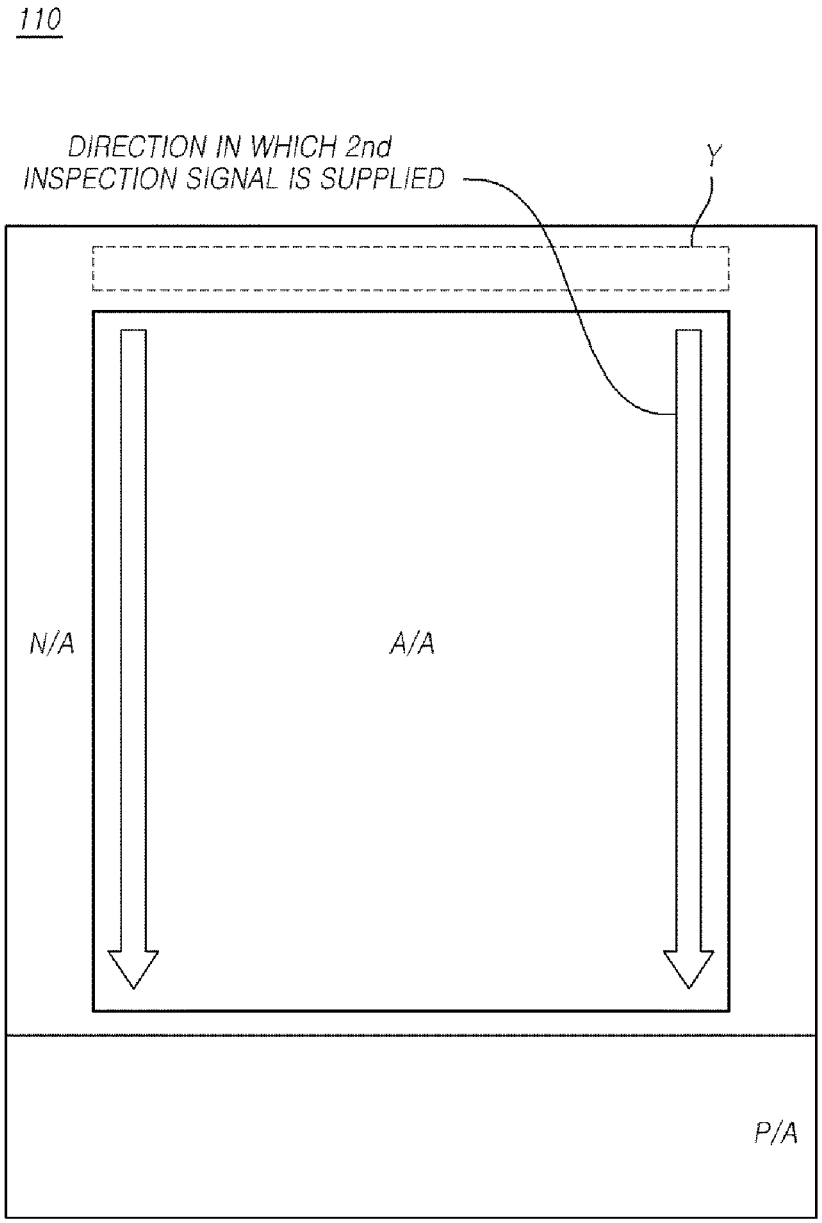
FIG. 6A and FIG. 6B illustrate a second auto-probe inspection process performed on the display panel of the display device according to an exemplary embodiment.
Figure 6B:
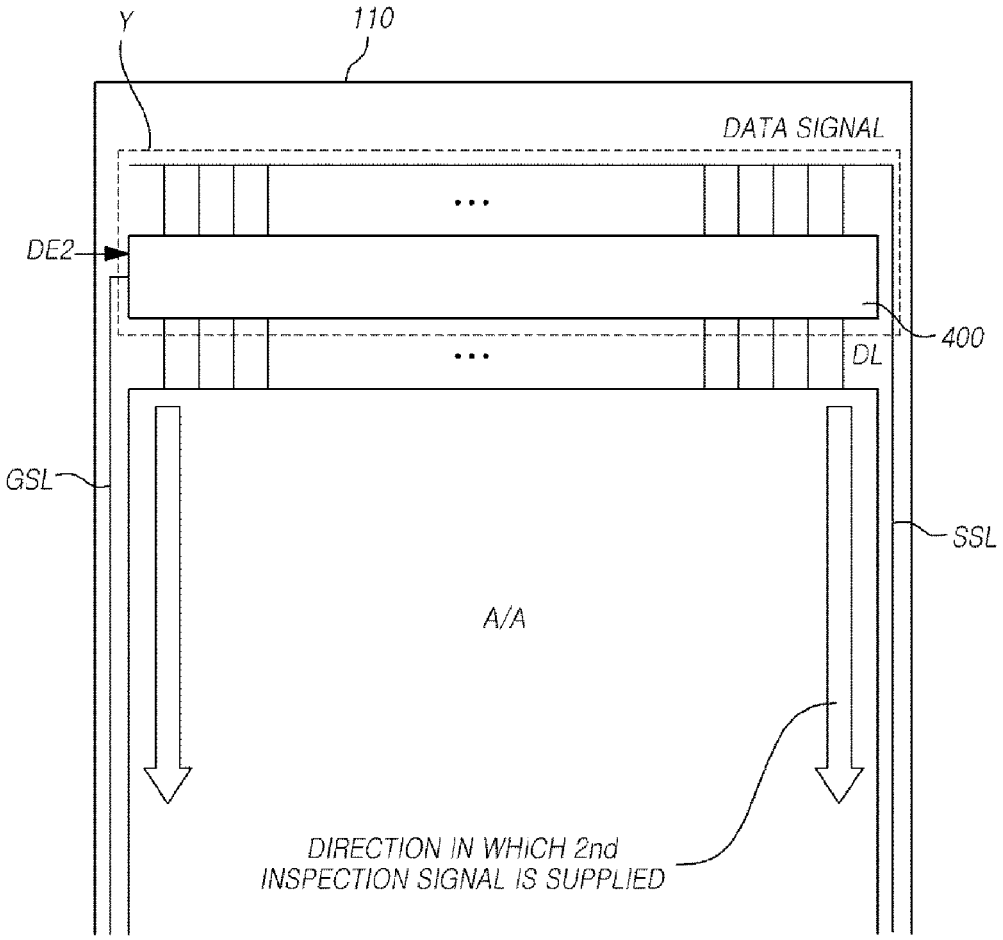

Next, FIG. 5A and FIG. 5B illustrate a first auto-probe inspection process performed on the display panel of the display device according to the present embodiment, and FIG. 6A and FIG. 6B illustrate a second auto-probe inspection process performed on the display panel of the display device according to the present embodiment. The display panel device according to the present embodiment includes the active area A/A including the plurality of subpixels; the pad area P/A having the first inspection circuit X disposed therein to supply first inspection signals to the active area A/A in order to perform a first auto-probe (AP) defect inspection process to determine whether or not a defect is present in the active area A/A; and a second inspection circuit Y facing the first inspection circuit X, with the active area A/A being situated between the first and second inspection circuits X and Y (refer to FIG. 5A and FIG. 5B).

The first inspection circuit X includes the plurality of output pads connected to the data lines disposed in the active area A/A, the first switching circuit 300 supplying the first inspection signals to the plurality of output pads, and first signal lines R, G, and B through which the first inspection signals are supplied to the first switching circuit 300 (refer to FIG. 5B). The plurality of output pads connected to the data lines disposed in the active area A/A are in the output pad section 320. The first data lines are connected to the red (R) subpixels of the active area A/A, the second data lines are connected to the green (G) subpixels of the active area A/A, and the third data lines are connected to the blue (B) subpixels of the active area A/A. The second inspection circuit Y includes a second switching circuit 400 connected to the data lines in the active area A/A and a second signal line SSL through which second inspection signals are supplied to the second switching circuit 400. The gate signal line GSL which makes the second switching circuit 400 enable is formed by a same process as the plurality of gate lines GLs in the active area A/A. The gate signal line GSL is used to inspect an RGB data signal supplied via first signal lines R, G, and B.

Although the first signal lines through which signals are supplied to the RGB subpixels are illustrated in the drawings, when the display panel 110 includes white (W) subpixels, the first inspection circuit X may further include fourth data lines through which the W subpixels are connected and W signal lines through which inspection signals are supplied to the fourth data lines. When the W subpixels are present, the inspection process described on the basis of the RGB subpixels can be applied in the same manner.

In the display panel and the inspection method thereof according to the present invention, a first auto-probe defect inspection process is performed using the first inspection circuit X. First inspection signals including RGB inspection signals are supplied to the first signal lines R, G, and B disposed in the first inspection circuit X and then to the data lines, whereby a determination can be made as to whether an open defect or a short defect is present in the data lines.

Thus, the first inspection signals may include the R inspection signals supplied to the R subpixels through the first data lines, the G inspection signals supplied to the G subpixels through the second data lines, and the B inspection signals supplied to the B subpixels through the third data lines. Since the first signal lines R, G, and B are connected to the first to third data lines, respectively, through the operation of the first switching circuit 300, the RGB inspection signals, i.e., the first inspection signals, are independently supplied to the first to third data lines, respectively.

That is, the RGB inspection signals may be simultaneously supplied to the first to third data lines or may be sequentially supplied to the first to third data lines at different points in time. In addition, the first inspection signals may be inspection signals for displaying a specific gray-scale pattern or a white pattern. In this case, the RGB inspection signals are supplied to the RGB subpixels to form a specific gray-scale pattern or are combined to display a white pattern. When the first inspection signals are the inspection signals for displaying the specific gray-scale pattern or the white pattern, the specific gray-scale pattern or the white pattern is displayed on the active area of the display panel in order to determine whether or not there is a defect in luminance.

In the first auto-probe defect inspection process, the first inspection signals are supplied in the direction of the active area A/A from the first inspection circuit X of the pad area P/A (refer to FIG. 5A). Here, a first data enable signal DEI is supplied to the first switching circuit 300 of the first inspection circuit X, such that the first inspection signals are supplied to the output pads of the output pad section 320 connected to the first to third data lines through the first switching circuit 300.

Predetermined output pads from among the output pads are used as dummy pads or non-used pads.

Referring to FIG. 6A and FIG. 6B, the second inspection circuit Y is disposed on the display panel 110 to face the first inspection circuit X. In other words, the active area A/A is situated between the first and second inspection circuits X and Y (e.g., the first and second inspection circuits X and Y, between which the active area A/A is situated, are disposed to face each other).

The second inspection circuit Y has the second switching circuit 400 and the second signal line SSL disposed thereon. The second switching circuit 400 is connected to the data lines of the active area A/A. The second signal line SSL allows second inspection signals to be supplied therethrough to the second switching circuit 400 to form a specific gray-scale pattern or a white pattern. The second signal line SSL supplies a gray-scale signal to the active area A/A.

The second switching circuit 400 of the second inspection section Y is connected to the data lines of the active area A/A in a one-to-one correspondence. Thus, the second switching circuit 400 of the second inspection section Y is different from the first inspection circuit X because the second switching circuit 400 of the second inspection section Y does not include dummy data lines alternating with the data lines DL. In other words, unlike in the first inspection circuit X, no dummy data lines in the second switching circuit 400 of the second inspection section Y alternate with the data lines DL.

In the second inspection circuit Y, the second inspection signals are supplied to all of the adjacent data lines. Thus, unlike in the display panel illustrated in FIG. 4A, no regions in the display panel illustrated in FIGS. 6A and 6B include large resistance differences alternating with the data lines.

When a second auto-probe defect inspection process is performed using the second inspection circuit Y, the second inspection signal is supplied to the active area A/A in the direction opposite to the direction of the first inspection signals in the first auto-probe defect inspection process.

The second inspection signal is supplied to the second switching circuit 400 through the second signal line SSL, and then simultaneously supplied to the data lines through the second switching circuit 400. At this time, a second data enable signal DE2 is supplied to the second switching circuit 400. The second signal line SSL and the data lines of the active area A/A are connected in common by the second data enable signal DE2. In addition, since the second inspection signal supplied to the second signal line SSL is supplied in common to the data lines after being supplied to the second switching circuit 400, the same second inspection signal is supplied to each of the data lines.

According to the present invention as described above, the first inspection signals supplied to the display panel by the first inspection circuit X and the second inspection signals supplied to the display panel by the second inspection circuit Y are signals for displaying the same gray-scale patterns. As a result, there is an advantage in that no defect in luminance caused by resistance differences is formed in the gray-scale patterns displayed by the second inspection circuit.

Figure 7:
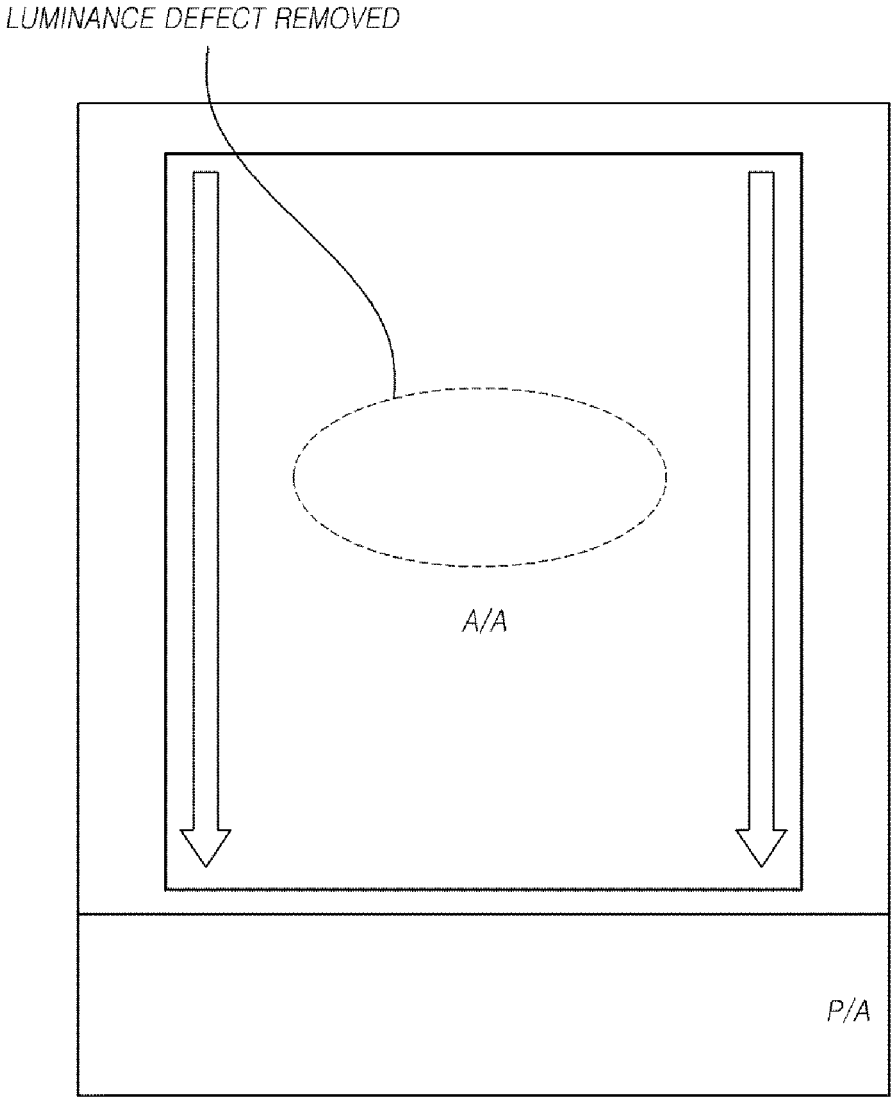
FIG. 7 illustrates the second auto-probe inspection process according to the exemplary embodiment in which no defect in luminance occurs.

Next, FIG. 7 illustrates the second auto-probe inspection according to the present embodiment in which no defect in luminance occurs. The second auto-probe defect inspection process according to the present embodiment forms no defect in luminance due to resistance differences when displaying a specific gray-scale pattern or a white pattern. In other words, there is no defect in luminance when the same second inspection signals are supplied to the data lines through the second switching circuit 400 connected to the data lines in the active area A/A in a one-to-one correspondence (refer to FIG. 6A and FIG. 6B).

In particular, the inspection method of a display panel according to the present embodiment may include a first auto-probe defect inspection process and a second auto-probe defect inspection process. The first auto-probe inspection process determines whether there is a defect (an open or short defect) in each of the data lines (first to third data lines) or whether there is a defect in color mixing among the subpixels.

In addition, the first auto-probe defect inspection process may determine whether there is a defect in luminance by simultaneously supplying RGB inspection signals having a specific gray-scale to display a specific gray-scale pattern or a white pattern. In particular, in the first auto-probe defect inspection process, even in the case in which there is no defect in the display panel, a defect in luminance (e.g., a dimmed area) is caused by the connection structure between the first inspection circuit X and the data lines.

In contrast, the second auto-probe defect inspection process according to the present embodiment can display a specific gray-scale pattern or a white pattern on the display panel using the second inspection circuit Y, on which no dummy pads are disposed differently from the first inspection circuit X. Thus, unless there is a defect in the display panel, no defect in luminance is formed due to resistance differences during the second auto-probe defect inspection process.

A more precise defect inspection process can thereby be performed on the display by comparing a first gray-scale pattern obtained by the first auto-probe defect inspection process with a second gray-scale pattern obtained by the second auto-probe defect inspection process. When no defect in luminance has occurred in the second auto-probe defect inspection process, unlike in the first auto-probe defect inspection process in which a defect in luminance has occurred, whether a defect in luminance that occurred in the first auto-probe defect inspection process is a real defect can be determined. Namely, a determination can be made of whether a defect in luminance occurring in the first auto-probe defect inspection process is caused, not by a real defect, but instead by the resistance differences formed by the dummy output pads (refer to FIG. 4A).

When a defect in luminance has been detected in both the first auto-probe defect inspection process and the second auto-probe defect inspection process, the display panel can be determined to be defective. Multiple types of sequences of the first and second auto-probe defect inspection processes can be used to determine whether the display panel is defective. Namely, the second auto-probe defect inspection process may be performed after the first auto-probe defect inspection process, or the first auto-probe defect inspection process may be performed after the second auto-probe defect inspection process.

In the display panel and the inspection method thereof according to the present invention as set forth above, the first inspection circuit and the second inspection circuit able to perform the auto-probe inspection process on the display panel are provided. Thereby, a more precise defect inspection process can be performed by comparing patterns displayed on the display panel by the first inspection circuit with patterns displayed on the display panel by the second inspection circuit.

Figure 8:
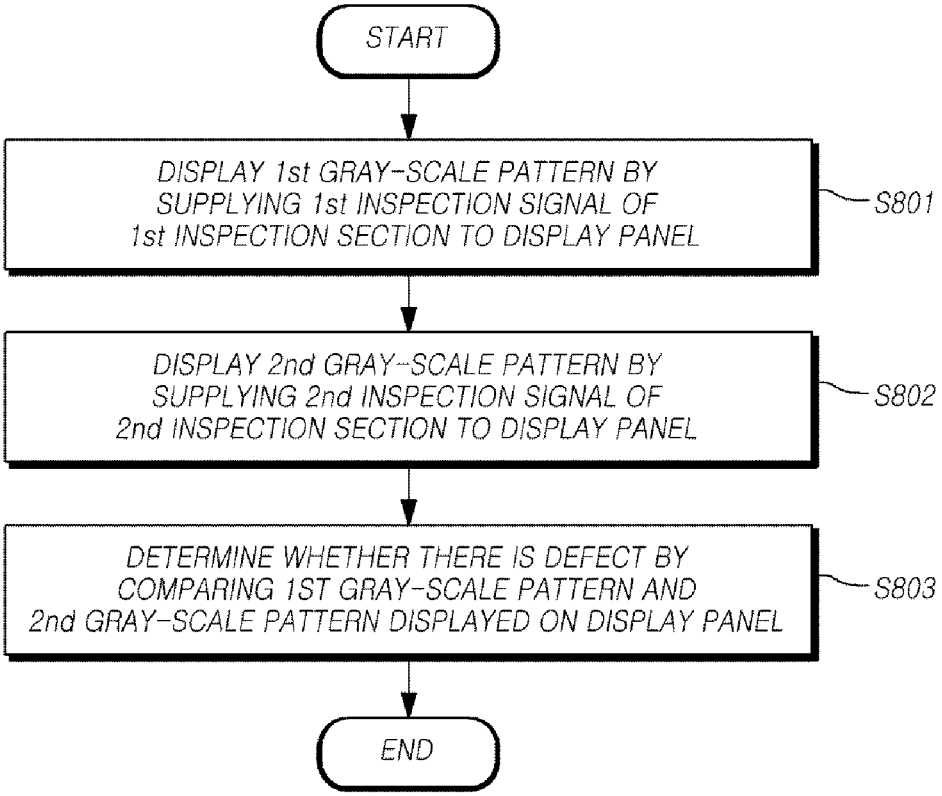
FIG. 8 is a flowchart illustrating an auto-probe defect inspection method according to an exemplary embodiment.

Next, FIG. 8 is a flowchart illustrating an auto-probe defect inspection method according to an exemplary embodiment. The auto-probe defect inspection method according to the present embodiment is an inspection method of a display panel. The display panel includes an active area including a plurality of subpixels, a pad area having a first inspection circuit disposed therein to supply first inspection signals to the active area, and a second inspection circuit facing the first inspection circuit, with the active area being situated between the first and second inspection circuits. The method includes a step S801 of displaying a first gray-scale pattern by supplying the first inspection signals to the active area of the display panel using the first inspection circuit; a step S802 of displaying a second gray-scale pattern by supplying second inspection signals to the active area of the display panel using the second inspection circuit; and a step S803 of determining whether or not there is a defect by comparing the first gray-scale pattern displayed by the first inspection signals with the second gray-scale pattern displayed by the second inspection signals.

The first gray-scale pattern and the second gray-scale pattern may be the same specific gray-scale patterns or the same white patterns. When a defect in luminance has occurred in both the first gray-scale pattern and the second gray-scale pattern, the display panel is determined to be defective. When a defect in luminance has occurred in the first gray-scale pattern while no defect in luminance has occurred in the second gray-scale pattern, the display panel is determined to be non-defective.

In the display panel and the inspection method thereof according to the present invention as set forth above, the first inspection circuit and the second inspection circuit are used to perform an auto-probe inspection process on the display panel. A more precise defect inspection process than in the display panel according to related art can thereby be performed by comparing patterns displayed on the display panel by the first inspection circuit with patterns displayed on the display panel by the second inspection circuit.

The foregoing descriptions and the accompanying drawings have been presented in order to explain the certain principles of the present invention. A person skilled in the art to which the invention relates can make many modifications and variations by combining, dividing, substituting for, or changing the elements without departing from the principle of the invention. The foregoing embodiments disclosed herein shall be interpreted as illustrative only but not as limitative of the principle and scope of the invention. The scope of the invention is not limited to the foregoing embodiments. It should be understood that the scope of the invention shall be defined by the appended claims and all of their equivalents fall within the scope of the invention.

What is claimed is:

1. A display panel comprising:

driver integrated circuits (ICs);

a plurality of data lines disposed in an active region;

a plurality of input pads disposed in a pad region and configured to supply a plurality of first signals to the driver ICs;

a plurality of output pads including used output pads electrically connected to first data lines among the plurality of data lines, respectively, and dummy output pads that are unused and electrically disconnected from all of the plurality of data lines, wherein the plurality of output pads are disposed in a first inspection circuit included in the pad region, the used output pads receiving the plurality of first signals from the plurality of input pads via the driver ICs;

a first switching circuit disposed in the first inspection circuit included in the pad region and connected to the used output pads, wherein the first switching circuit is configured to supply the plurality of first signals to the first data lines via the used output pads;

a plurality of first signal lines configured to supply the plurality of first signals to the used output pads via the first switching circuit;

a second switching circuit disposed in a second inspection circuit and connected to all of the plurality of data lines in the active region; and a second signal line configured to supply a plurality of second signals to the second switching circuit, wherein the used output pads of the first inspection circuit are grouped into a plurality of used output pad groups, and at least one dummy output pad among the dummy output pads is disposed between adjacent output pad groups among the plurality of used output pad groups, and wherein the plurality of first signals are respectively supplied to the first data lines which are less than all of the plurality of data lines, and the second signals are supplied to all of the plurality of data lines.

2. The display panel according to claim 1, wherein the plurality of output pads are connected to the plurality of data lines via link lines.

3. The display panel according to claim 1, wherein the first switching circuit is positioned at a bottom side of the active region, and the second switching circuit is positioned at a left, right, or top side of the active region.

4. The display panel according to claim 1, wherein the second signals supplied by the second switching circuit are in a direction opposite to a direction of the plurality of first signals supplied by the first switching circuit.

5. The display panel according to claim 1, wherein predetermined output pads among the plurality of output pads are used as the dummy output pads.

6. The display panel according to claim 1, wherein the second switching circuit receives the second signals from the second signal line and supplies the second signals to the all of the plurality of data lines.

7. The display panel according to claim 1, wherein the plurality of first signals comprise red, green, and blue signals supplied to the plurality of first signal lines for displaying each of red, green, and blue color patterns, respectively.

8. The display panel according to claim 1, wherein the second signals supplied to the second signal line comprise red, green, and blue signals for displaying a gray-scale pattern.

9. The display panel according to claim 1, wherein the plurality of first signals are sequentially supplied to the plurality of data lines.

10. The display panel according to claim 1, wherein a resistance difference between first and second output pad groups among the plurality of used output pad groups is different than a resistance difference between the second output pad group and a third output pad group among the plurality of used output pad groups.

11. The display panel according to claim 1, further comprising:

a first pad positioned in a non-active region to connect to a first data enable circuit;

a second pad positioned in the non-active region to connect to a second data enable circuit; and a plurality of third pads positioned in the non-active region to connect to the plurality of first signal lines, respectively.

12. The display panel according to claim 1, wherein the plurality of first signals comprise red, green, and blue signals for displaying a first gray-scale pattern by first pixels among a plurality of pixels included in the active region and corresponding to the first data lines, wherein the plurality of second signals comprise red, green, and blue signals for displaying a second gray-scale pattern by all of the plurality of plurality of pixels for comparing the second gray-scale pattern to the first gray-scale pattern to detect a defect.

13. The display panel according to claim 12, wherein the first gray-scale pattern is same as the second gray-scale pattern for determining whether there is a defect in luminance in the display panel.

14. A display panel comprising:

a plurality of data lines and a plurality of gate lines disposed in an active region, the plurality of data lines crossing the plurality of gate lines to define a pixel region;

a plurality of input pads disposed in a non-active region;

a plurality of output pads including used output pads electrically connected to first data lines among the plurality of data lines, respectively, and dummy output pads that are unused and electrically disconnected from all of the plurality of data lines, wherein the used output pads are configured to receive a plurality of first signals from the plurality of input pads;

a first data enable circuit disposed in a first region and configured to supply the plurality of first signals to the first data lines via the used output pads; and a second data enable circuit disposed in a second region and configured to supply a plurality of second signals to all of the plurality of the data lines, wherein the plurality of first signals comprise red, green, and blue signals for displaying each of red, green, and blue color patterns, respectively, wherein the plurality of second signals comprise red, green, and blue signals for displaying a gray-scale pattern, wherein the used output pads are grouped into a plurality of used output pad groups, and at least one dummy output pad among the dummy output pads is disposed between adjacent output pad groups among the plurality of used output pad groups, and wherein the plurality of first signals are respectively supplied to the first data lines which are less than all of the plurality of data lines, and the second signals are supplied to all of the plurality of data lines.

15. The display panel according to claim 14, further comprising:

a plurality of first signal lines configured to supply the plurality of first signals to the used output pads via the first data enable circuit; and a second signal line configured to supply the plurality of second signals to the second data enable circuit.

16. The display panel according to claim 15, wherein the plurality of first signal lines and the plurality of second signal lines are disposed on a same layer as the plurality of gate lines to connect to the first and second data enable circuits, respectively.

17. The display panel according to claim 14, wherein the first data enable circuit is positioned at a bottom side of the active region, and the second data enable circuit is positioned at a left, right, or top side of the active region.

18. The display panel according to claim 17, wherein the plurality of second signals supplied by the second data enable circuit are in a direction opposite to a direction of the plurality of first signals supplied by the first data enable circuit.

19. The display panel according to claim 14, wherein a resistance difference between first and second output pad groups among the plurality of used output pad groups is different than a resistance difference between the second output pad group and a third output pad group among the plurality of used output pad groups.

20. The display panel according to claim 14, further comprising:

a first pad positioned in the non-active region to connect to the first data enable circuit;

a second pad positioned in the non-active region to connect to the second data enable circuit; and a plurality of third pads positioned in the non-active region to connect to the plurality of first signal lines, respectively.

* * * * *